US005540351A

United States Patent [19]

Luescher

[11] Patent Number: 5,540,351

[45] Date of Patent: Jul. 30, 1996

[54] ANIMAL WASTE CONTAINER

[76] Inventor: Cecilia N. Luescher, 3031 NE. 51st St., Apt. 301, Fort Lauderdale, Fla. 33308

[21] Appl. No.: 328,799

[22] Filed: Oct. 31, 1994

[51] Int. Cl.[6] ..... B65D 90/04

[52] U.S. Cl. ..... 220/407; 220/403; 220/408; 220/908; 232/43.2

[58] Field of Search ..... 220/403, 404, 220/908, 407; 248/95, 907; 242/590, 596.8, 598.5; 232/43.2

[56] References Cited

U.S. PATENT DOCUMENTS

| | | | |
|---|---|---|---|
| 1,131,847 | 3/1915 | Lucas | 220/908 X |
| 1,424,520 | 8/1922 | Richardson et al. | 220/908 X |
| 2,125,122 | 7/1938 | Mongiello | 220/908 X |
| 2,384,709 | 9/1945 | Thoren | 220/404 |
| 3,057,506 | 10/1962 | Wetlesen | 220/908 X |
| 3,153,629 | 10/1964 | Sabol | 220/908 X |
| 3,687,328 | 8/1972 | Spruyt et al. | 220/908 X |
| 3,800,503 | 4/1974 | Maki | 220/404 X |
| 4,364,490 | 12/1982 | Lang et al. | 248/95 X |

*Primary Examiner*—Allan N. Shoap
*Assistant Examiner*—Niki M. Kopsidas
*Attorney, Agent, or Firm*—Joseph Zallen

[57] ABSTRACT

A sanitary animal-waste container suitable for installation in public places. The container has a cover and an interiorly-mounted roll of detachable plastic waste bags accessible through a cut-out in the container.

7 Claims, 1 Drawing Sheet

ANIMAL WASTE CONTAINER

BACKGROUND OF INVENTION

This invention relates to an animal waste container and, in particular, to a sanitary waste container suitable for installation in public places.

One purpose of this invention is to provide a sanitary means for disposing of animal waste.

Other objects and advantages of this invention will be apparent from the description and claims which follow taken together with the appended drawings.

SUMMARY OF INVENTION

The invention comprises generally a weather-resistant container, open at its upper end and provided with a cover. A roll of separable plastic waste bags is mounted either on the interior of the cover or the container. Sufficient space is provided for insertion of a waste bag into the container while the cover is in place. This is preferably accomplished by making the cover in the form of a panel curved from side to side, and having a cut-out on the upper portion of the front of the container. The cover is preferably hingedly connected to the upper portion of the shell and kept locked. Sufficient space is provided on the top of the side surfaces of the container for external access to the rolls of plastic bags.

The container is preferably rectangular in cross section and has a hinged door on its front to permit removal of deposited waste. Disposable waste receptacles may be placed into the container as well into as a reusable liner, such as a perforated plastic or metal mesh liner. The container preferably has a perforated support floor for the waste receptacles.

SPECIFIC EXAMPLE OF INVENTION

Figure 2:
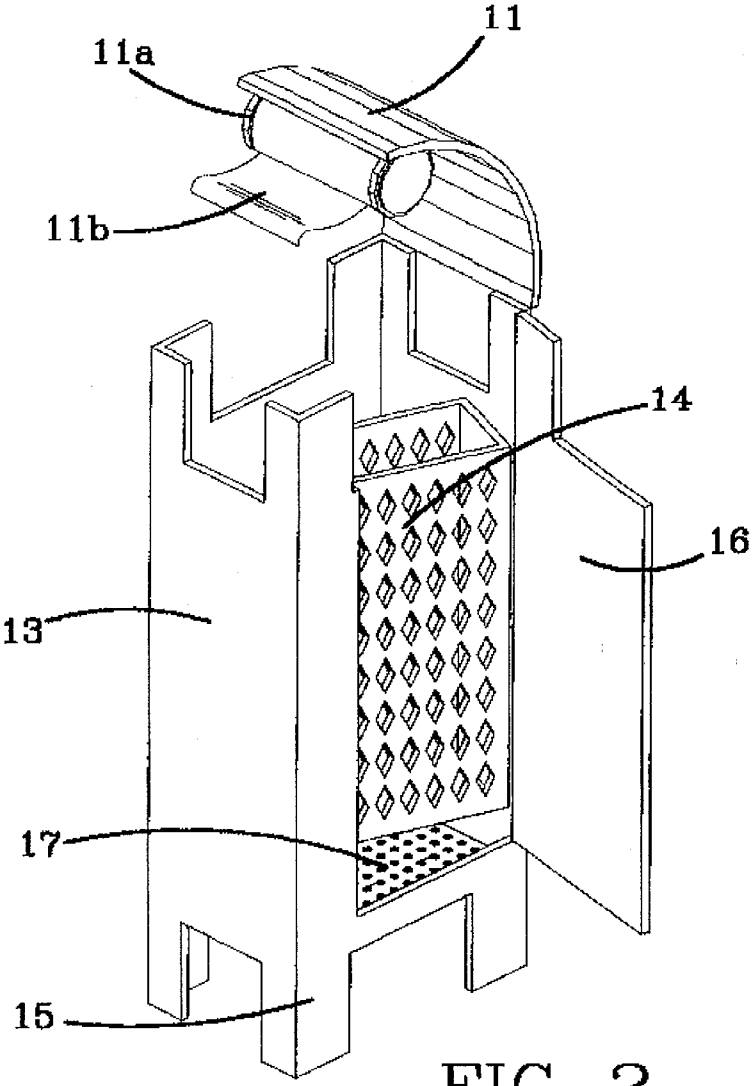
FIG. 2 is a right perspective view with the cover raised and the door open.
Figure 1:
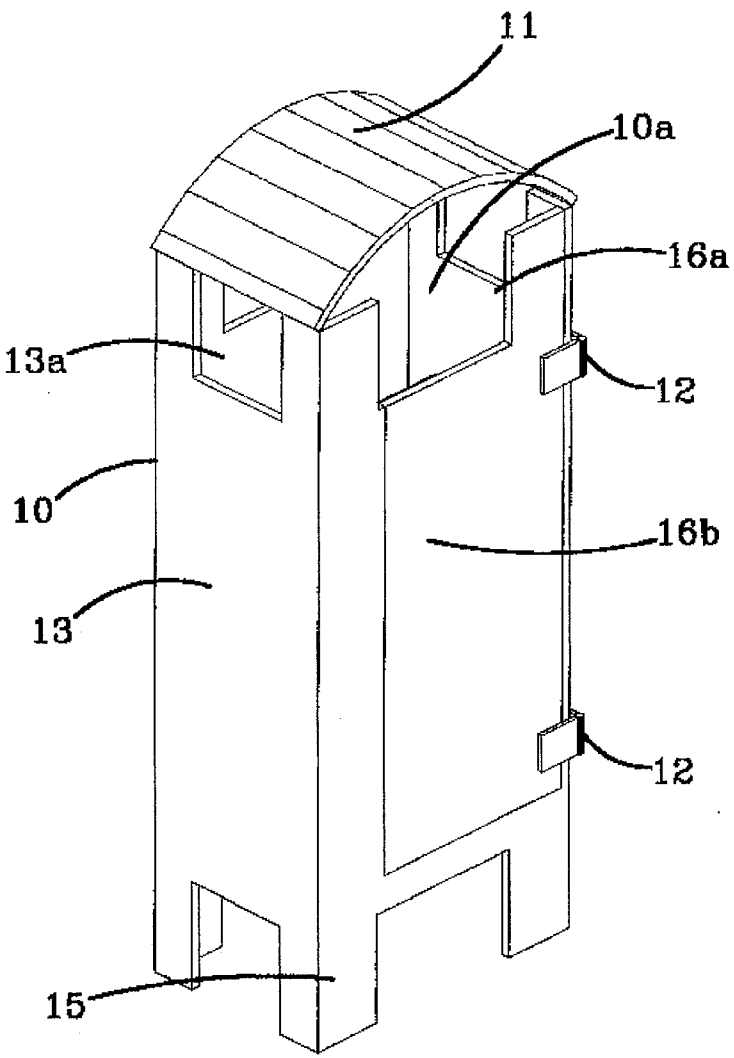
FIG. 1 is a left perspective view of one embodiment of this invention with the cover closed and the front door closed.

Referring now to the drawings, there is illustrated therein a container 10 of rectangular cross-section and made of a weather-resistant material such as painted or galvanized metal. The container includes a pair of side panels 13, a front panel 16, and feet 15. The side panels 13 have upper openings 13*a*, and the front panel 15 has a top cutout area 16*a*. The front panel includes a door 16*b* attached to the side panel 13 by hinges 12. A curved cover 11 is hingedly connected to the side panel 13 and contains hubs 11*a* which support a roll of detachable plastic bags 11*b* and are attached inferiorly to its edge. A perforated, metal, reusable liner 14 is positioned in the interior space 10*a* of the container and is supported on a perforated floor 17.

Although the illustrated embodiment shows the container supported by feet, it can also be supported by a pedestal or it can be mounted on a wall at an appropriate height.

I claim:

1. A sanitary animal-waste container (10) suitable for installation in public places, said container comprising a weather-resistant shell (10) having an open upper end, a side surface (13), a front surface (16), and a cover (11) on said upper end, and means mounted on the interior surface of the cover for supporting a roll of separable plastic bags; said side surface (13) having an opening (13*a*) through which such a plastic bag may be withdrawn; said front surface (16) having an upper cutout (16*a*) for front insertion into the open end of such a plastic bag in which animal waste has been stowed.

2. The container of claim 1 wherein there is a reusable, perforated liner (14) within.

3. The container of claim 1 wherein the front surface (16) has a hinged door to permit removal of deposited waste.

4. The container of claim 1 wherein there is a perforated support floor (17).

5. The container of claim 1 having a ground support (15).

6. The container of claim 1 wherein said cover is outwardly curved from side to side.

7. The container of claim 1 wherein said shell is rectangular in cross-section providing side walls (13) and front wall (16).

* * * * *